US007621394B2

(12) United States Patent
McCambridge et al.

(10) Patent No.: US 7,621,394 B2
(45) Date of Patent: Nov. 24, 2009

(54) BLADE HOLDER

(75) Inventors: James E. McCambridge, Polo, IL (US); Luther D. Langley, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 460 days.

(21) Appl. No.: 11/187,578

(22) Filed: Jul. 22, 2005

(65) Prior Publication Data

US 2007/0017837 A1 Jan. 25, 2007

(51) Int. Cl.
*A45C 11/26* (2006.01)
*B65D 5/50* (2006.01)
*B26B 21/24* (2006.01)

(52) U.S. Cl. ..... 206/354; 206/350; 206/806; 206/736; 30/40

(58) Field of Classification Search ..... 206/308.3, 206/350, 351, 352, 354, 387.14, 561–564, 206/736, 340, 740, 745, 45.2, 806; 30/40, 30/74, 541; 220/476, 480, 481; 248/37.3, 248/37.6, 207.222, 224.8, 349.1, 412; 211/70.7, 211/80, 81, 97; 221/285
See application file for complete search history.

(56) References Cited

U.S. PATENT DOCUMENTS 624,919 A * 5/1899 Folger ..... 211/39
1,813,686 A * 7/1931 Stetson ..... 206/216
2,996,004 A * 8/1961 Sinkiewicz ..... 101/333
3,043,047 A * 7/1962 La Fleur ..... 248/454
3,388,662 A * 6/1968 Ravreby ..... 101/405
4,366,904 A * 1/1983 Roskvist ..... 206/425
4,497,412 A * 2/1985 Labelle ..... 211/70.7
D287,425 S * 12/1986 Kirchner ..... D6/630
4,684,019 A * 8/1987 Egly ..... 206/309
4,848,574 A * 7/1989 Murphy et al. ..... 206/308.3
5,137,147 A * 8/1992 Halper ..... 206/81
5,348,152 A * 9/1994 Kiyoshi et al. ..... 206/354
5,833,334 A * 11/1998 Harper ..... 312/257.1
6,237,232 B1 * 5/2001 Petricca et al. ..... 30/526
6,315,120 B1 * 11/2001 Tally et al. ..... 206/373
2005/0051444 A1 * 3/2005 Hurt et al. ..... 206/315.11

* cited by examiner

*Primary Examiner*—Mickey Yu
*Assistant Examiner*—Melissa L Lalli
(74) *Attorney, Agent, or Firm*—Greer, Burns & Crain, Ltd.

(57) ABSTRACT

A holder for holding a plurality of blades, where one embodiment of the holder includes a base portion, a main body and an openable cover portion. The main body is preferably configured and arranged to be removably attached to the base portion. There are a plurality of cells defined within the main body, with each cell configured and arranged to hold at least one blade on a seating portion, wherein the seating portion defines a blade seating plane. Additionally, the openable cover portion is preferably configured and arranged to be removably attached to the main body. Preferably, the base portion is separate from the main body, and these components are preferably configured to enable the holder to either be attached to a wall or seated on a horizontal surface.

25 Claims, 9 Drawing Sheets

BLADE HOLDER

The present invention relates generally to a holder for holding a plurality of blades, and more particularly to a holder with a plurality of cells that are each configured to hold at least one blade.

BACKGROUND OF THE INVENTION

Hair trimmers and clippers often include a number of different blades for trimming hair to different lengths and/or for trimming different types of hair. Typically, these blades are stored loosely in a drawer. However, when the drawer is opened or closed, the blades can move about in the drawer, possibly contacting each other, which may damage the blades. Further, loose blades stored in a drawer often end up being disorganized as they shift positions when the drawer is opened or closed. Thus, there is a need for a device for storing and organizing blades.

Currently, mobile grooming vans are becoming popular, especially for pet or animal grooming. Such grooming vans contain all of the supplies that a stationary hair salon or pet grooming facility would contain, except that they are all contained within the van. Such a van travels to the client's residence, and the hair stylist or animal groomer performs the styling or grooming inside of the van, thereby eliminating the need for the client to travel to visit a salon or grooming facility. However, with the use of such vans, the blades move around in the drawers even more than with a drawer in a stationary facility. Accordingly, there is also a need for a blade holder for keeping blades safe and organized for use in the mobile grooming vans, as well as for use in stationary salons and animal grooming centers.

BRIEF SUMMARY OF THE INVENTION

The above-listed objects are met or exceeded by the present blade holder, which features a main body with a plurality of cells, each configured and arranged to hold at least one blade. Preferably, the blade holder also includes a separate base section that enables the holder to either be attached to a wall or seated on a horizontal surface.

More specifically, one embodiment of the present invention provides a holder for holding a plurality of blades, where the holder includes a base portion, a main body and an openable cover portion. The main body is preferably configured and arranged to be removably attached to the base portion, and it includes first and second sides connected by first and second ends. There are also a plurality of cells defined within the main body, with each cell configured and arranged to hold at least one blade on a seating portion, wherein the seating portion defines a blade seating plane. Additionally, the openable cover portion is preferably configured and arranged to be removably attached to the main body.

An embodiment of the present invention also relates to a holder for holding a plurality of blades, where the holder includes a main body with a plurality of cells, with each cell configured to hold at least one blade; and at least one magnet associated with at least one of the cells, whereby the magnet assists in maintaining a blade within an associated cell.

Additionally, an embodiment of the present invention also relates to a holder for holding a plurality of blades, where the holder includes a main body with a plurality of cells, with each cell configured to hold at least one blade, and wherein the cells are configured and arranged to hold the blades at an oblique angle with respect to either a horizontal surface or a vertical surface.

BRIEF DESCRIPTION OF THE SEVERAL VIEWS OF THE DRAWINGS

Preferred embodiments of the present invention are described herein with reference to the drawings wherein:

FIG. 3A is a modified version of the invention shown in FIG. 3;

DETAILED DESCRIPTION OF THE INVENTION

Figure 1:
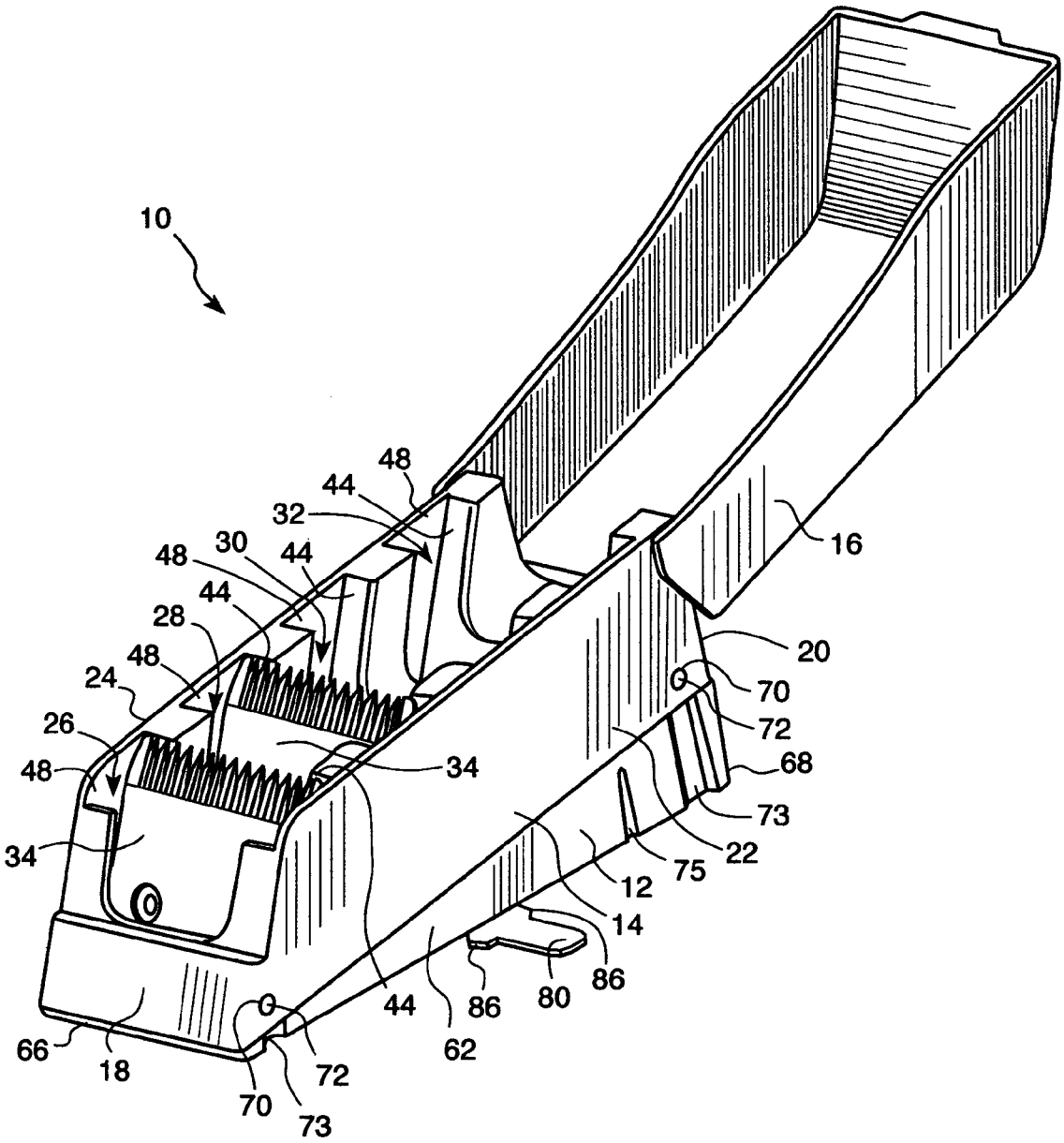
FIG. 1 is a top perspective view of one embodiment of the present invention, showing a holder attached to a base with the cover opened, where the unit is seated on a horizontal surface.

Turning now to FIG. 1, one example of an embodiment of the present blade holder 10 is shown. In this embodiment, holder 10 includes a base portion 12, a main body 14 and an openable cover portion 16. Each of these components is preferably made of plastic, although other materials (such as natural or synthetic rubber, wood or metal) are also contemplated as being within the scope of the invention. Additionally, the cover portion 16 is preferably transparent to allow the user to see the blades stored therein, while still protecting the blades from dust.

Figure 5:
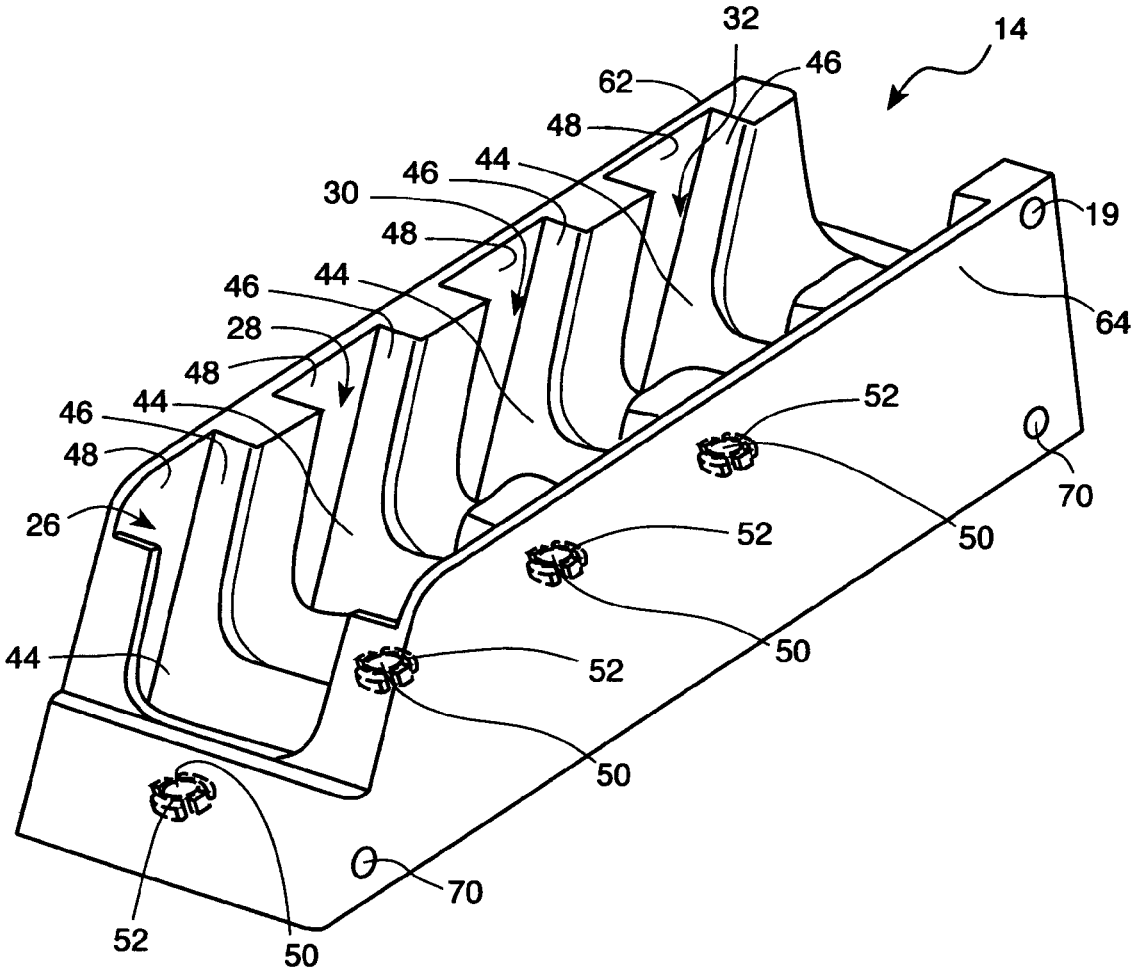
FIG. 5 is a front perspective view of a main body of a holder only, without a base or a cover.

In the preferred embodiment, the cover portion 16 is pivotably attached to the main body 14 via a hinge arrangement, such as via projections (not shown) extending from the cover portion that are configured to mate with apertures 19 in the main body (shown in FIG. 5). Such a configuration also allows for easy removal of the cover portion 16 from the main body 14. Of course, other configurations for attaching the cover portion to the main body, with either a pivotable connection or not, are also within the scope of the invention. Further, an embodiment of the invention consisting of the main body alone, without the cover portion and base portion, is also contemplated as being within the scope of the invention.

Figure 2:
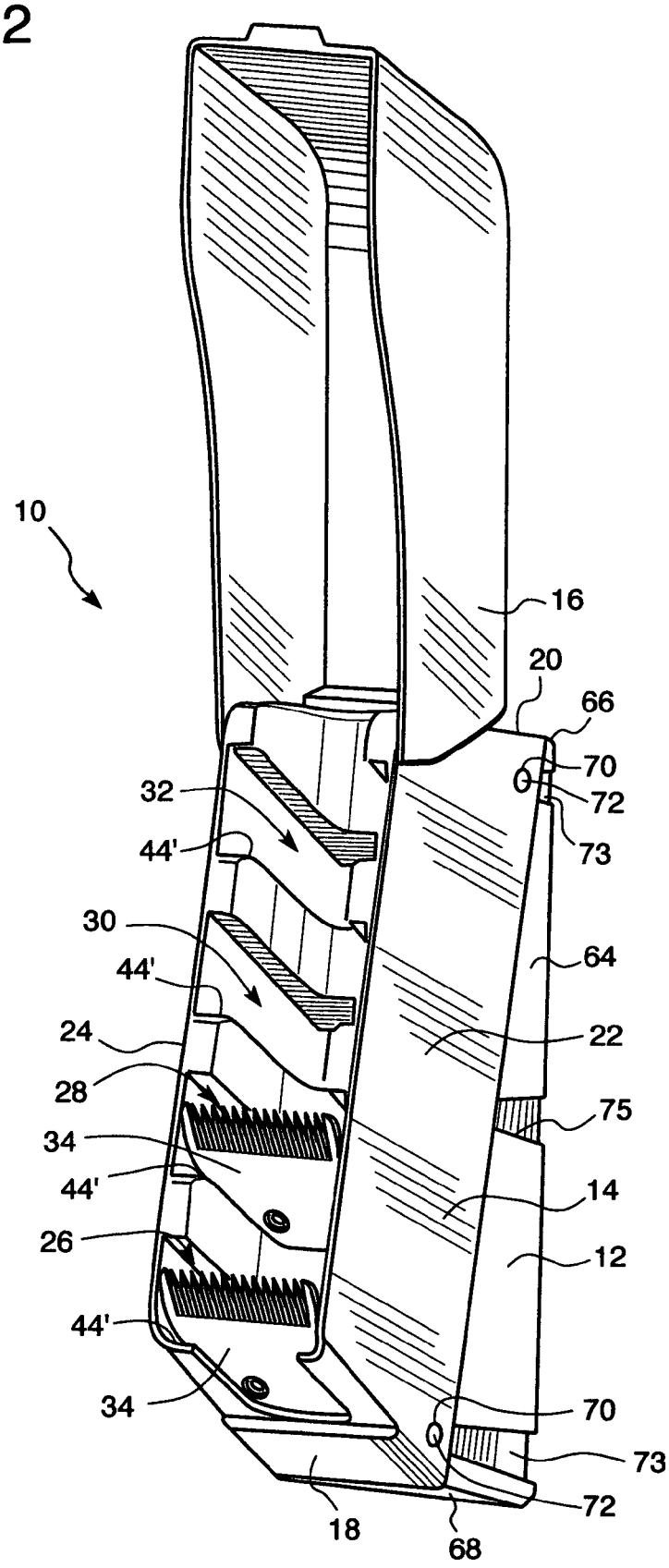
FIG. 2 is a front perspective view of one embodiment of the present invention, showing a holder attached to a base with the cover opened, where the unit is attached to a vertical surface.

Preferably, the main body 14 is configured to be removably attached to the base portion 12 in one of two configurations—a first configuration for use on a horizontal surface, such as on a counter or a table, as shown in FIG. 1, and a second configuration for use on a vertical surface, such as on a wall of a shop or a mobile grooming van, as shown in FIG. 2. To switch between configurations, the base portion 12 is separated from the main body 14, the base portion 12 is rotated 180° with respect to the main body 14, and then the base portion 12 is re-attached to the main body 14, as described more fully below.

Referring back to FIG. 1, the features of the present invention in the first configuration will be described. In this configuration, the holder 10 can be seated upon a horizontal surface, such as on a counter or table, or within a drawer. The main body 14 of the holder includes a lower face surface (or end) 18, and upper face surface (or end) 20, and two side face surfaces, 22 and 24. There are a plurality of compartments, or cells, 26, 28, 30, 32 formed on the main body 14, with each cell being configured to receive at least one blade 34 for a clipper or trimmer. In the preferred embodiment, each cell is configured to hold a single blade 34, which prevents contact between the blades. However, it is contemplated that each cell could be configured to hold two or more blades, such as blades 33 and 33' of cell 32 of FIG. 3A, if such contact between blades is not a concern. Further, although the embodiment shown includes four cells (26, 28, 30, 32), more than four cells could be provided, if desired. Likewise, less than four cells could also be provided, if fewer cells are needed.

Each of the cells 26, 28, 30, 32 is preferably sized to receive blades of the largest dimensions of a particular blade set. Accordingly, smaller blades within the blade set will also be able to fit within a certain cell. However, it is also contemplated that each of the cells could be specifically configured for a certain size blade, which would provide a better organizing feature. For example, the cells could be incrementally reduced in size along the length of the holder so that each cell accommodates a single blade of a corresponding size within a blade set. Additionally, if desired, markings could be provided on each cell designating the appropriate size of blade for a particular cell, which would provide an additional organizing feature.

As shown in FIGS. 1-5 and 6, each of the cells preferably includes a blade seating portion or surface 44, which defines a blade seating plane; a rear surface 46, and two side surfaces 48 (with only one side surface being shown in FIGS. 1 and 5 for each cell). In the preferred embodiment, each of the blade seating planes defined by surfaces 44 are preferably substantially parallel to each other, and are preferably at an angle of approximately 60° with respect to surface 65. However, it is also contemplated that some of the blade seating planes could be oriented at different angles from each other, thereby making at least one of the blade seating planes not parallel to at least one of the other blade seating planes, such as surface 44' of FIG. 3A. It is also contemplated that angles other than 60°, such as angles between 45° and 75°, could also be used. As seen most clearly in FIG. 6, each of the blade seating surfaces 44 is preferably of a generally U-shaped configuration, whereby the center of the "U" defines a void to facilitate gripping of a blade 34 when the user intends to remove the blade from the cell.

Figure 6:
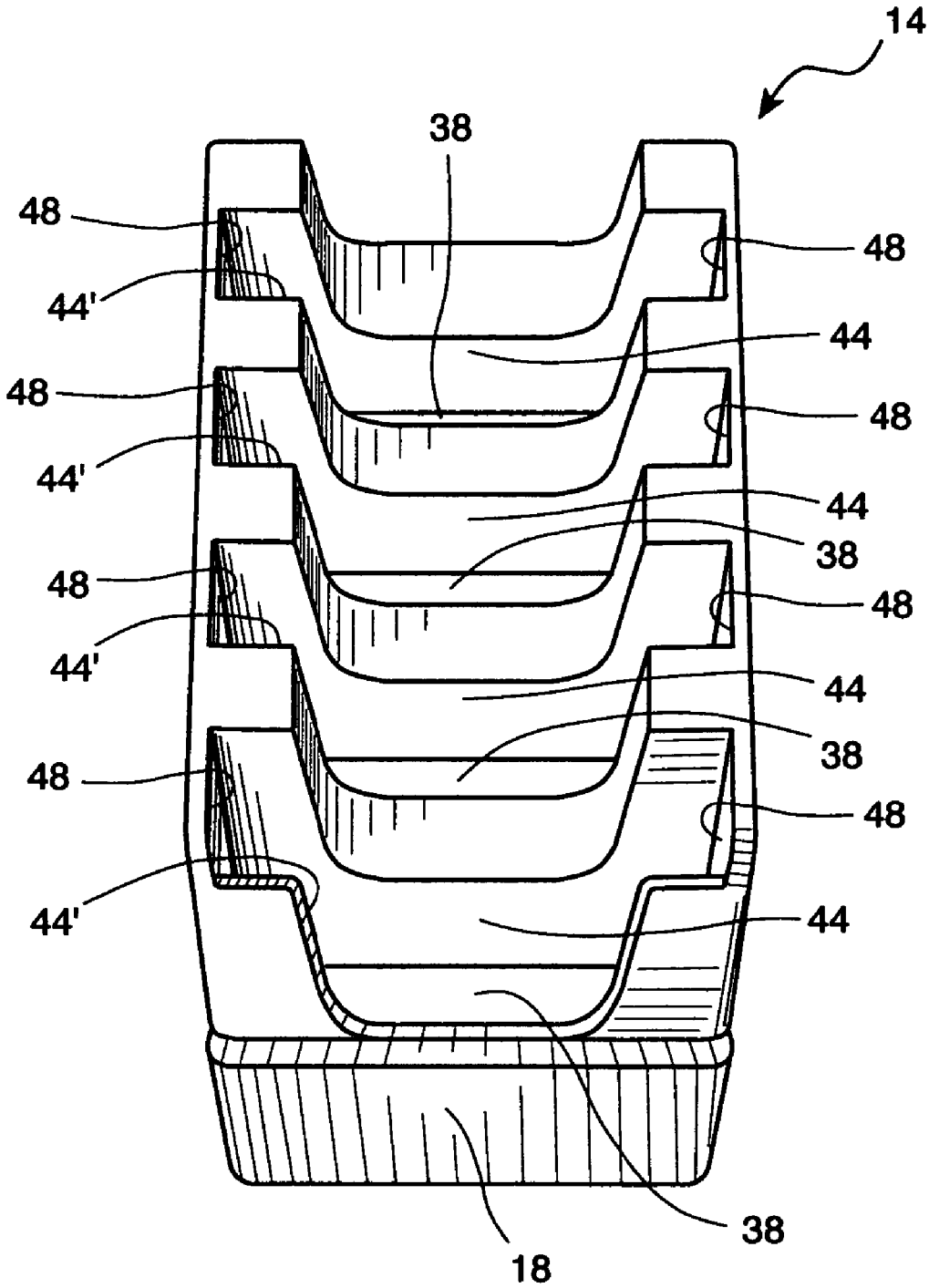
FIG. 6 is a top view of the main body of the holder of FIG. 5.
Figure 7:
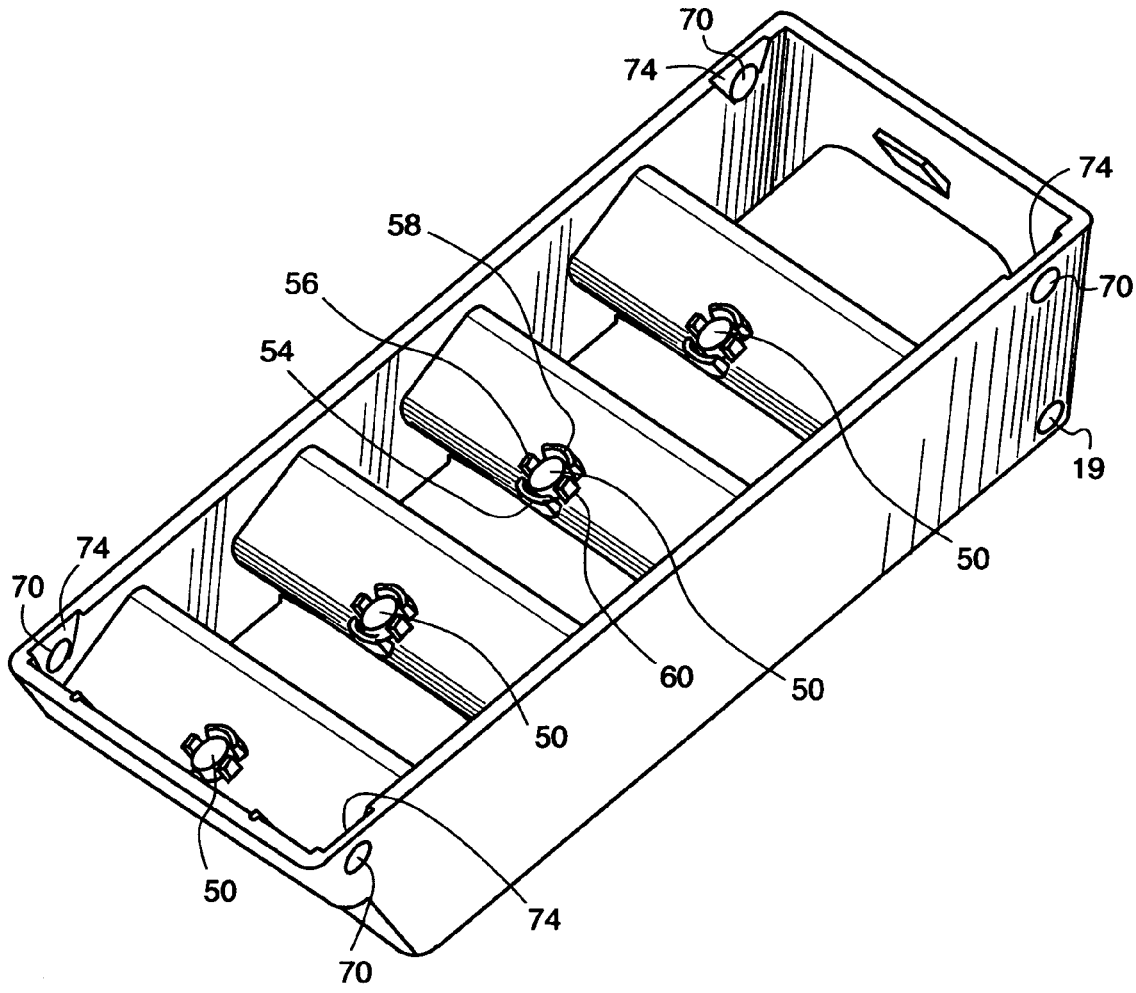
FIG. 7 is a rear perspective view of a main body of a holder only, without a base or a cover.

Turning again to FIGS. 5 through 7, some additional features of the present invention will be discussed. FIG. 5 is a front perspective view of only a main body 14 of a holder, showing how this component can be used without the base, and, if desired, without the cover. Of course, the main body could also be used with a cover, while still eliminating the base. FIG. 6 is a top view of the main body 14, and FIG. 7 is a rear perspective view of the main body. In order to better maintain the blades 32 in position within the cells, at least one magnet 50 is preferably provided on the rear surface 46 of each cell 26, 28, 30, 32, as shown in FIG. 5. Preferably, such magnets will be at least strong enough to keep the blades from rattling within the cells when used in a mobile grooming van. So as not to impede the magnetic field from reaching the blades, the rear surface 46 of each cell preferably includes a cutout portion 52.

As shown in the rear perspective view of the main body 14 of FIG. 7, each magnet 50 may be held in place by a plurality of tabs 54, 56, 58, 60, that extend outwardly from the back of each rear surface 46. The preferred embodiment includes two side tabs 56, 60, an upper tab 58 and a lower tab 54. The side tabs 56, 60 are preferably generally straight, and the upper and lower tabs 58, 54, respectively, are preferably curved. Such an arrangement allows the magnets 50 to be easily snapped into place, and then securely maintained in position. Of course, alternate means for maintaining the magnets in position are also contemplated as being within the scope of the invention.

Figure 3:
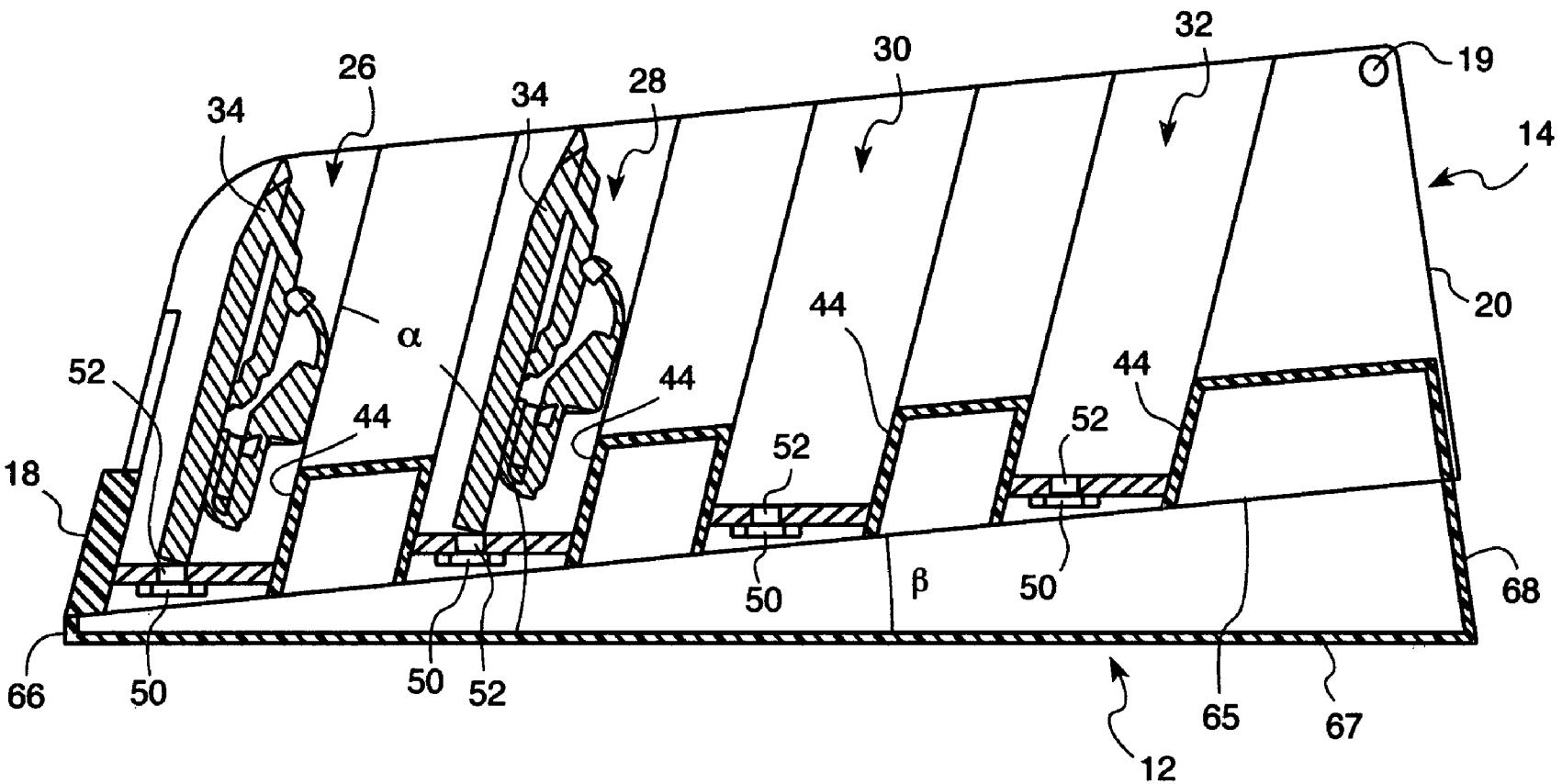
FIG. 3 is a side cross-section of FIG. 1, except that the cover has been detached and removed.
Figure 4:
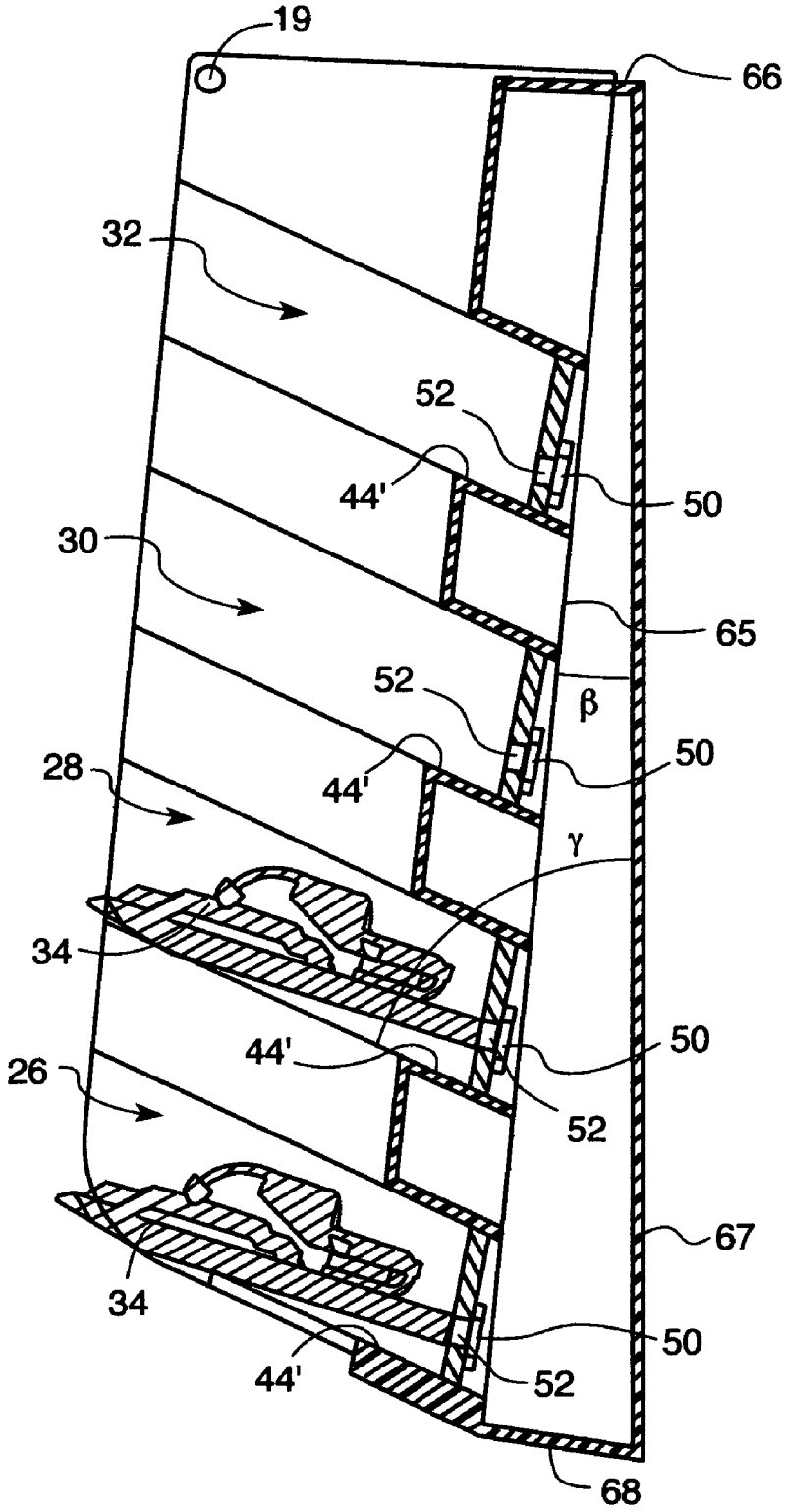
FIG. 4 is a side cross-section of FIG. 2, except that the cover has been detached and removed.

Referring again to FIG. 1, as well as to FIG. 3, which is a side cross-section of FIG. 1, it can be seen that in the first configuration, the base 12 is attached to the bottom of the main body 14 so that the holder 10 can be seated upon a table or a counter, or within a drawer, without allowing the blades to move and contact each other, even when the drawer is opened or closed. The base portion 12 is generally wedge-shaped when viewed from the side, as most clearly seen in FIG. 3. Thus, as shown in FIG. 1, base portion 12 includes two side surfaces 62, 64 (see FIG. 2), a relatively thin end surface 66 and a relatively thick end surface 68. If desired, ridges, such as ridge 75, shown in FIGS. 1 and 2, may be provided in base portion 12 to add additional strength.

In order to attach the main body 14 to the base portion 12, the main body 14 preferably includes a plurality of apertures 70 (also shown in FIG. 6) that are each configured to receive a corresponding one of the projections 72 formed on the base portion 12. To facilitate insertion of the projections into the apertures, each of the projections is preferably seated within a channel 73, which acts as a spring-like hinge, as seen in FIGS. 1, 2, 7 and 8, and the areas surrounding the apertures 70 are preferably formed with indentations 74, as seen in FIG. 7.

In the embodiment shown, there are four projections and four apertures. However, a different number of aperture/projection sets could be used, if desired. Additionally, the locations of the projections and the apertures need not be in the positions shown, and instead could be located at various different locations. Moreover, the locations of projections and apertures could also be reversed when compared to those of the embodiment shown, so that the projections are found on the main body and the apertures are found on the base portion. Of course, other means for attaching the main body to the base portion are also contemplated as being within the scope of the invention.

In the configuration of FIGS. 1 and 3, the main body 14 is attached to the base portion 12 so that the thin end 66 of the base portion 12 is adjacent to the lower face surface 18 of the main body 14 and the thick end 68 of the base portion 12 is adjacent to the upper face surface 20 of the main body. As best shown in FIG. 3, such an arrangement places the blades at a predetermined oblique angle with respect to a horizontal surface. More specifically, in the preferred embodiment, when the main body 14 and the base portion 12 are in the first configuration, the angle $\alpha$ defined between the blade seating surface 44 and the horizontal surface (which is also essentially the same as the angle between the blade and the horizontal surface) is preferably between the range of approximately 60° and approximately 80°, with approximately 68°-70° being most preferred. By choosing an angle $\alpha$ between the range of approximately 60° and approximately 80°, the blades are tilted upward enough to allow any size or other markings on the blades to be readily visible, as well as to allow easy insertion and removal of the blades to/from the holder. If the angle α is too large, the blades may tip forward, and if the angle α is too small, easy access to the blade may be hindered.

Included within angle α is angle β, which is the angle defined between the sloped surface 65 of the generally wedge-shaped base 12 and its bottom surface 67. In the preferred embodiment, angle β is preferably approximately 8°, but angles between approximately 5° and approximately 10° are also acceptable.

Turning now to FIG. 2, a second configuration of the holder 10 of the present invention is shown. The components of the holder shown in FIG. 2 are the same as those shown in FIG. 1, except that the orientation of the base portion 12 has been changed. More specifically, the base portion 12 has been rotated 180° so that now the thick end 68 of the base portion 12 is adjacent to the lower face surface 18 of the main body 14 and the thin end 66 of the base portion 12 is adjacent to the upper face surface 20 of the main body. One of the features of the present invention is that the same device can be switched between the configuration of FIG. 1 and the configuration of FIG. 2, depending upon the desired use. In the FIG. 2 configuration, the holder 10 can be attached to a vertical surface, such as the interior wall of a mobile grooming van. When attached to a wall, the blades are held at an appropriate angle that provides easy access to them, while still preventing the blades from slipping out of the holder while the vehicle makes turns, if the holder is mounted within a vehicle.

More specifically, in the preferred embodiment, when the main body 14 and the base portion 12 are in the second configuration (the configuration of FIGS. 2 and 4), the angle γ defined between the blade seating surface 44' and the vertical surface (which is also approximately the same as the angle between the blade and the vertical surface) is preferably between the range of approximately 45° and 65°, with approximately 52°-54° being most preferred. It should be noted that in the configuration of FIGS. 2 and 4, the blade seating surface 44' is the surface opposed to the blade seating surface 44 of the configuration of FIGS. 1 and 3.

Additionally, due to the geometry of the combination of the base 12 and the main body 14, the difference between angle α and angle γ (with angle α being greater than angle γ) is double the value of angle β. For example, assuming angle β is 5° and angle α is 80°, then angle γ would be 70° (i.e., 80°−(2×5°)=70°).

Figure 8:
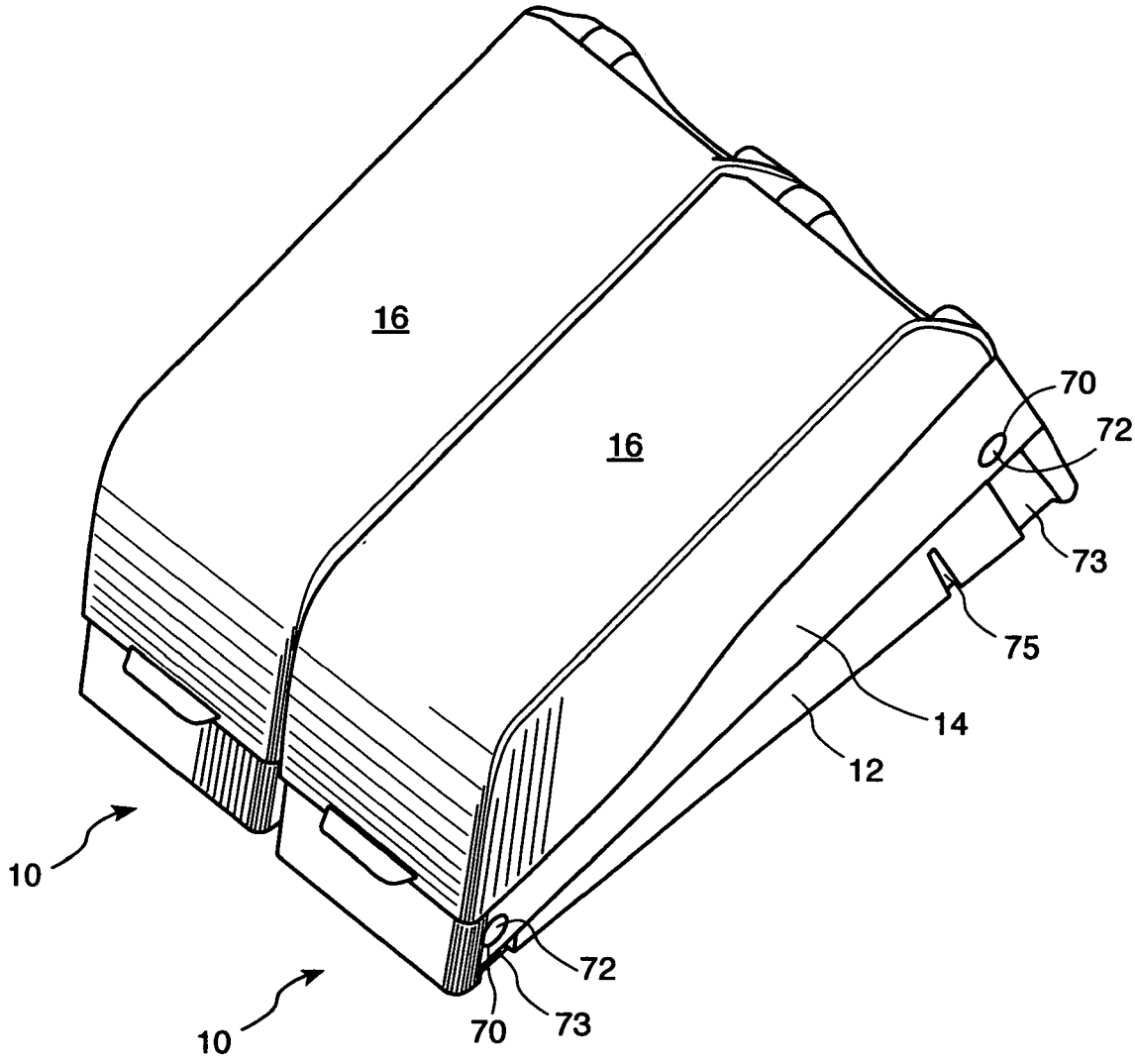
FIG. 8 is a top perspective view of two holder units attached together.
Figure 9:
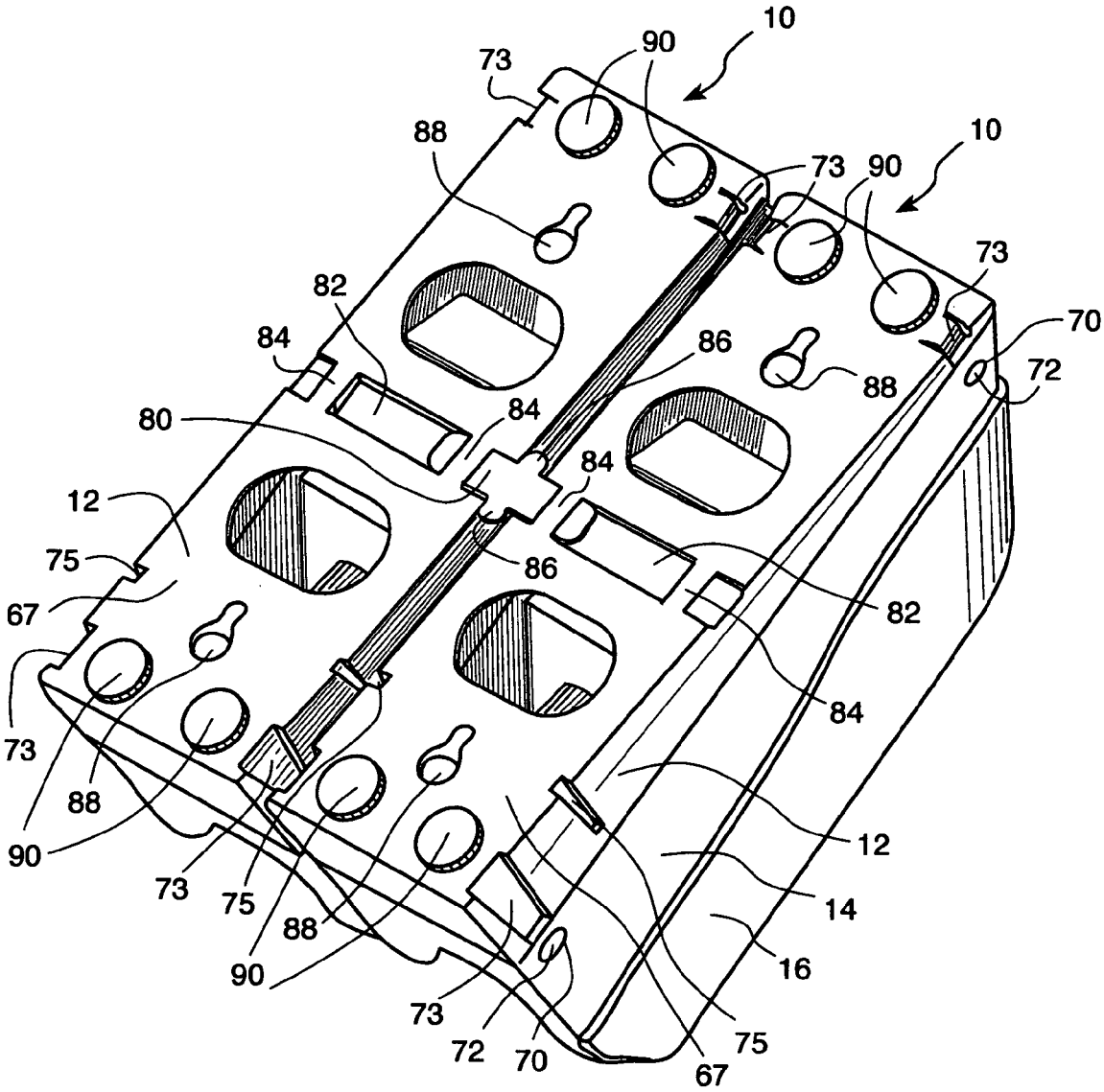
FIG. 9 is a bottom perspective view of two holder units attached together.

Turning now to FIGS. 8 and 9, one method of attaching two holder units 10 together is shown, where FIG. 8 is a top view and FIG. 9 is a bottom view. Of course, the units can be attached together in either the first configuration or the second configuration. Additionally, more than two units can be attached together, if desired. In the preferred embodiment, the two units 10 are attached together through the use of tongue 80, which is configured to slide within a slot 82 found on the bottom of each base 12. Integrally-formed strips 84 serve to maintain tongue 80 within slots 82. Tongue 80 preferably also includes stop projections 86, which serve as stops to prevent the tongue from being pushed too far into the slots 82.

As also shown in FIG. 9, the rear surface 67 of base 12 also includes one or more apertures 88, which are used to attach the holder unit (or units) to a wall, such as the wall of a mobile grooming van, or another generally vertical surface. Of course, other attachment means, either permanent or removable, are also contemplated as being within the scope of the invention.

In addition, the rear surface 67 of the base 12 also preferably includes one or more cushions 90. These cushions are for preventing the holder 10 from sliding (especially when in the FIG. 1 configuration) and for providing means for dampening vibrations before they reach the holder (especially when in the FIG. 2, and the holder is attached to the wall of a mobile grooming van). Cushions 90 are preferably made of rubber or other elastomeric material, but can also be made o any material that serves the purposes mentioned above.

While particular embodiments of the holder for holding a plurality of blades have been shown and described, it will be appreciated by those skilled in the art that changes and modifications may be made thereto without departing from the invention in its broader aspects and as set forth in the following claims.

Various features of the invention are set forth in the appended claims.

What we claim is:

1. A holder for holding a plurality of blades, the holder comprising:

a base portion, wherein said base portion is generally wedge-shaped, when viewed from a side thereof, thereby creating a relatively thick end and a relatively thin end, and further wherein said base portion defines a base plane extending along a bottom surface between said relatively thick end and said relatively thin end;

a main body configured and arranged to be removably attached to said base portion, a plurality of cells defined within said main body, with each cell configured and arranged to hold at least one blade on a seating portion that is adjacent a base of each cell, wherein said main body includes first and second sides connected by first and second ends; and an openable cover portion configured and arranged to be removably attached to said main body, wherein said base portion and said main body are both configured such that said main body may be attached to said base portion in either:

a first configuration with said first end of said main body adjacent to said relatively thin end of said base portion and said second end of said main body adjacent to said relatively thick end of said base portion, wherein said seating portion defines a first blade seating plane in said first configuration; or a second configuration with said first end of said main body adjacent to said relatively thick end of said base portion and said second end of said main body adjacent to said relatively thin end of said base portion, wherein said seating portion defines a second blade seating plane in said second configuration, wherein said first blade seating plane defines an angle α with respect to said base plane and said second blade seating plane defines an angle γ with respect to said base plane, wherein angle γ is less than angle α, and further wherein said angle α is within the range of 60°-80°, and said angle γ is within the range of 45°-65°.

2. The holder according to claim 1 wherein:

when said base portion and said main body are attached together in said first configuration, said holder is configured and arranged to be seated upon a generally horizontal surface; and when said base portion and said main body portion are attached together in said second configuration, said holder is configured and arranged to be mounted upon a generally vertical surface.

3. The holder according to claim 2, wherein angles defined between said first and second blade seating planes and said base plane defined by a rear portion of said base portion, where said rear portion is configured to contact both said generally horizontal surface and said generally vertical surface, are different depending upon whether said base portion and said main body are attached together in said first configuration or in said second configuration.

4. The holder according to claim 1, wherein said first blade seating planes of all of said cells are substantially parallel to each other, and said second blade seating planes of all of said cells are substantially parallel to each other.

5. The holder according to claim 1, wherein at least one of said first blade seating planes is not parallel with respect to at least one other first blade seating plane.

6. The holder according to claim 1, further comprising at least one magnet associated with at least one of said cells, whereby said magnet assists in maintaining a blade within an associated cell.

7. The holder according to claim 1, wherein said cover portion is at least partially transparent and is attached to said main body via a hinge arrangement.

8. The holder according to claim 1, further comprising:

a plurality of apertures on one of said main body or said base portion; and a plurality of projections on the other of said main body and said base portion, wherein locations of said projections correspond to locations of said apertures such that said main body can be attached to said base portion.

9. The holder according to claim 8, wherein:

each of said projections is seated within a channel; and each of said apertures is formed within a indentation.

10. The holder according to claim 1, wherein:

said angle $\alpha$ is within the range of 68°-70°; and said angle $\gamma$ is within the range of 52°-54°.

11. A system including a plurality of clipper blades and a holder for holding said plurality of clipper blades, the holder comprising:

a base portion of a generally wedge-shaped configuration, when viewed from a side thereof, wherein said wedge-shape is defined between a base plane and a sloped surface, with an angle $\beta$ being defined between said base plane and said sloped surface;

a main body including a plurality of cells, with each cell configured to hold at least one of said clipper blades, said main body being configured and arranged to be seated upon said base portion in either one of a first configuration or a second configuration; and at least one magnet associated with at least one of said cells, whereby said at least one magnet assists in maintaining said clipper blade within an associated cell, wherein when said main body is seated upon said base portion in said first configuration, a clipper blade seated in one of said cells leans against a first seating portion that defines a first blade seating plane, and when said main body is seated upon said base portion in said second configuration, a clipper blade seated in one of said cells leans against a second seating portion that defines a second seating plane, where said first seating portion is different from said second seating portion, wherein said first seating plane defines an angle $\alpha$ with said base plane in said first configuration and said second seating portion defines an angle $\gamma$ with said base plane in said second configuration, where said angle $\alpha$ is greater than said angle $\gamma$, and further wherein the difference between said angle $\alpha$ and said angle $\gamma$ is approximately double the value of said angle $\beta$.

12. The system according to claim 11, wherein:

said angle $\beta$ is within the range of 5°-10°;

said angle $\alpha$ is within the range of 60°-80°;

said angle $\gamma$ is within the range of 45-65°.

13. The system according to claim 11, further comprising an openable cover portion configured and arranged to be removably attached to said main body.

14. The system according to claim 13, wherein said cover portion is pivotably attached to said main body.

15. The system according to claim 11, wherein at least one of said magnets is associated with each of said cells.

16. The system according to claim 11, wherein each of said cells is configured and arranged to receive blades of a plurality of different sizes.

17. The system according to claim 16, wherein each of the cells is configured and arranged to seat only a single blade.

18. The system according to claim 16, wherein each of said cells is configured to seat a plurality of blades.

19. The system according to claim 11, wherein each of said magnets is seated behind a cutout portion formed in said cell.

20. The system according to claim 11, wherein:

said angle $\beta$ is approximately 8°;

said angle $\alpha$ is within the range of 68°-70; and said angle $\gamma$ is within the range of 52°-54°.

21. A system including a plurality of clipper blades and a holder for holding said plurality of clipper blades, the holder comprising:

a main body including a plurality of cells, with each cell configured to hold at least one of said clipper blades, and a base portion of a generally wedge-shaped configuration, wherein said base portion is configured to be positioned below said main body in either a first configuration or a second configuration, where said second configuration results from rotating said main body by 180 degrees, with respect to said base portion, from said first configuration, wherein the cells are configured and arranged to hold the clipper blades at a first oblique angle with respect to a horizontal surface when in said first configuration and the cells are configured and arranged to hold the clipper blades at a second oblique angle with respect to a vertical surface when in said second configuration, and further wherein each of said cells includes two fixed seating portions, against one of which one of said clipper blades is seated when positioned within said cell when in said first configuration and against the other of which one of said clipper blades is seated when positioned within said cell when in said second configuration.

22. The system according to claim 21, wherein each of said cells is configured and arranged to hold a single blade on one of said two fixed seating portions, where, in each cell, one of said fixed seating portions defines a blade seating plane in said first configuration and the other of said fixed seating portions defines a blade seating plane in said second configuration.

23. The system according to claim 22, wherein at least two of said blade seating planes of different cells are parallel to each other, and said first oblique angle is different from said second oblique angle.

24. The system according to claim 21, wherein said fixed seating portions are angled and are integrally formed with said main body.

25. The system according to claim 21, wherein each of said fixed seating portions is of a generally U-shaped configuration, thereby defining a void to facilitate removal of one of said clipper blades from said cell.

* * * * *